US008483596B2

(12) United States Patent
Seorl et al.

(10) Patent No.: US 8,483,596 B2
(45) **Date of Patent: *Jul. 9, 2013**

(54) ARTICLE OF CONSUMPTION AND IMAGE FORMING APPARATUS HAVING THE SAME

(75) Inventors: Kwoang Joe Seorl, Suwon-si (KR); Myoung Sub Jang, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/558,488

(22) Filed: Jul. 26, 2012

(65) Prior Publication Data

US 2012/0301183 A1 Nov. 29, 2012

Related U.S. Application Data

(63) Continuation of application No. 12/137,994, filed on Jun. 12, 2008, now Pat. No. 8,238,789.

(30) Foreign Application Priority Data

Jul. 12, 2007 (KR) ..... 10-2007-70230

(51) Int. Cl.
*G03G 15/02* (2006.01)

(52) U.S. Cl.
USPC ..... 399/116

(58) Field of Classification Search
USPC ..... 399/107, 108, 110, 116, 117
See application file for complete search history.

(56) References Cited

U.S. PATENT DOCUMENTS 6,941,093 B2 9/2005 Park et al.
6,952,545 B2 10/2005 Baek
2005/0094217 A1 5/2005 Molchan et al.
2006/0177237 A1 8/2006 Kim et al.

FOREIGN PATENT DOCUMENTS

| | | |
|---|---|---|
| CN | 1577143 | 2/2005 |
| JP | 3140971 | 6/1991 |
| JP | 3282484 | 12/1991 |
| JP | 2000-263839 | 9/2000 |
| JP | 2006064888 | 3/2006 |
| JP | 2006215225 | 8/2006 |
| KR | 10-2005-0110224 | 11/2005 |

OTHER PUBLICATIONS

English Language abstract of KR 10-2005-0110224, published Nov. 23, 2005.
European Search Report issued in counterpart European Application No. 08 15 8937, mailed Nov. 12, 2008.
English language abstract of JP 2000-263839, published Sep. 26, 2008.
Machine English language translation of JP 2000-263839, published Sep. 26, 2008.

(Continued)

*Primary Examiner* — David Gray
*Assistant Examiner* — Gregory H Curran
(74) *Attorney, Agent, or Firm* — Stanzione & Kim, LLP

(57) ABSTRACT

An image forming apparatus having a consumable detachably installed in the main body is disclosed. The image forming apparatus includes a main body having a first opening, a consumable which is detachably installed in the main body, a door mounted on the main body to open and close the first opening, and locking members operable in association with the movement of the door to secure the consumable in place as the door is closed. Possible damages due to the movement of the consumable such as a photosensitive cartridge during shipping and/or transporting of the image forming apparatus can be prevented by the locking members.

8 Claims, 8 Drawing Sheets

OTHER PUBLICATIONS

Office Action issued in Chinese Application No. 200810131809.2, mailed Jan. 15, 2010.

English language translation of Office Action issued in Chinese Application No. 200810131809.2, mailed Jan. 15, 2010.

English language abstract of CN 1577143, published Feb. 9, 2005.

Korean Office Action issued Sep. 15, 2011 in KR Application 10-2007-0070230.

Japanese Office Action issued Nov. 18, 2011 in JP Application No. 2008-174682.

ARTICLE OF CONSUMPTION AND IMAGE FORMING APPARATUS HAVING THE SAME

CROSS-REFERENCE TO RELATED APPLICATIONS

This application is a Continuation Application of prior application Ser. No. 12/137,994, filed on Jun. 12, 2008 now U.S. Pat. No. 8,238,789 in the United States Patent and Trademark Office, which claims the benefit of Korean Patent Application No. 2007-070230, filed on Jul. 12, 2007 in the Korean Intellectual Property Office, the disclosure of which is incorporated herein by reference.

BACKGROUND OF THE INVENTION

1. Field of the Invention

The present invention relates to an image forming apparatus, and, more particularly, to an image forming apparatus having a detachable photosensitive cartridge.

2. Description of the Related Art

An image forming apparatus is an apparatus which prints an image on, e.g., a sheet of paper serving as the printing medium based on image signals. In an image forming apparatus, a laser beam is irradiated on a photosensitive drum charged with a predetermined potential to form an electrostatic latent image on an outer peripheral surface thereof. The electrostatic latent image is developed into a visible image with developer. Then, the visible image is transferred and fixed on the paper, thereby printing the image.

As disclosed in Korean Patent Laid-open Publication No. 2005-110224, a conventional image forming apparatus includes a main body defining the external appearance, a developing unit which develops an image on the paper, and the like. The developing unit may include one or more of an exposure unit having, e.g., a laser diode to generate a laser beam, a photosensitive cartridge having a photosensitive drum on which an electrostatic latent image is formed by the laser beam irradiated by the exposure unit, a charge roller which charges the photosensitive drum, a developing cartridge which develops the electrostatic latent image into a visible image using a developer, a transfer unit which transfers the visible image formed on the photosensitive drum on the paper, and a fixing unit which fixes the visible image on the paper by heating and pressing the visible image transferred on the paper.

Consumables such as the photosensitive cartridge may be detachably installed in the main body, allowing them to be replaced, e.g., when they are exhausted. When the image forming apparatus with detachably installed consumable(s) is transported or shipped via a vehicle or the like, due to the vibration and/or shock imparted the image forming apparatus during the transport, the consumables may move from their original positions in the main body, and may become damaged.

Conventionally, some padding material or the like may be placed into the main body to prevent the movement of the consumables within the image forming apparatus body during packaging for shipment. Once the image forming apparatus reaches its intended location of operation, the padding material is removed. Although not intended to be a part of the image forming apparatus in operation, such padding material is nevertheless manufactured and/or purchased for use as packing material In addition, the padding material needs to be removed from the main body and disposed of before use. Consequently, it presents inconvenience to the user, and results in waste of material.

SUMMARY OF THE INVENTION

The present invention has been made in order to solve the above problems. It is an aspect of the invention to provide an image forming apparatus capable reducing the risk of detachably installed consumables, e.g., a photosensitive cartridge, being damaged during the transporting or shipping of the image forming apparatus.

Additional aspects and/or advantages of the invention will be set forth in part in the description which follows and, in part, will be obvious from the description, or may be learned by practice of the invention.

In accordance with an embodiment, there is provided an image forming apparatus comprising: a main body having a first opening; a consumable which is detachably installed in the main body; a door which is rotatably installed on the main body to open and close the first opening; and a locking member operable in association with the door to secure the consumable in place when the door is closed.

Slide bars may be installed on the main body to be movable in first and second directions as the door is opened and closed, respectively, and the locking members may be rotatably installed on the slide bars to secure/release the consumable as the slide bars move.

Ends of the slide bars further from the first opening may be elastically biased toward the first opening by elastic members, and the opposite ends of the slide bars may be supported by the pressing bars movably installed on the door.

Each of the locking members may include a pair of hook members forming an angle therebetween and a hinge portion connecting the hook members, the hinged portion being rotatably installed on each of the slide bars.

The image forming apparatus may further include engaging protrusions, each engaging protrusion being configured to engage any one of a pair of the hook members as the slide bars move back and forth in the first and second directions, to allow the locking members to rotate.

The image forming apparatus may further include an exposure unit which is disposed below the consumable within the main body, and which has a light window formed on its upper surface, and a light window cover installed on the slide bars move back and forth along with the slide bars to open and close the light window.

The engaging protrusions may be formed to protrude from opposite sides of a cover plate which covers an upper side of the exposure unit.

The consumable may include a photosensitive cartridge having a photosensitive drum on which an electrostatic latent image is to be formed.

In accordance with another aspect, there is provided an image forming apparatus comprising: a main body having a second opening; a paper drawer moving into and out of the main body through the second opening; and a consumable which is detachably installed in the main body; and locking members which secure the consumable in place as the paper drawer moves into the main body.

Slide bars may be installed on the main body to be movable in first and second directions as the paper drawer moves into and out of the main body, and the locking members may be rotatably installed at the slide bars to secure/release the consumable as the slide bars move back and forth in the first and second direction.

Ends of the slide bars further from the second opening may be elastically biased toward the second opening by elastic members, and the opposite ends of the slide bars may be supported by the pressing protrusions protruding from the paper drawer.

According to yet another aspect, an image forming apparatus that may be operable with a detachably mounted consumable component thereof may comprise: a main enclosure defining an internal volume of the image forming apparatus, the internal volume including a consumable component mount location at which the detachably mounted consumable component is to be located during an image forming operation of the image forming apparatus, the main enclosure including an opening that provides a user access into the internal volume; an access door mounted on the main enclosure in such manner to open and close the opening; and at least one locking member moveably mounted within the internal volume, the at least one locking member being configured to move in association with the access door between at least a locking position and a release position, the at least one locking member being in the locking position when the access door closed, and being in the release position when the access door is open, the at least one locking member being, when in the locking position, configured to interfere with the detachably mounted consumable component to prevent the detachably mounted consumable component from moving from the consumable component mount location, the at least one locking member being further configured to, when in the release position, allow the detachably mounted consumable component from moving from the consumable component mount location.

BRIEF DESCRIPTION OF THE DRAWINGS

These and/or other aspects and advantages of the embodiments of the invention will become apparent and more readily appreciated from the following description of the embodiments, taken in conjunction with the accompanying drawings, of which:

in FIG. 1;

DETAILED DESCRIPTION OF THE PREFERRED EMBODIMENTS

Figure 1:
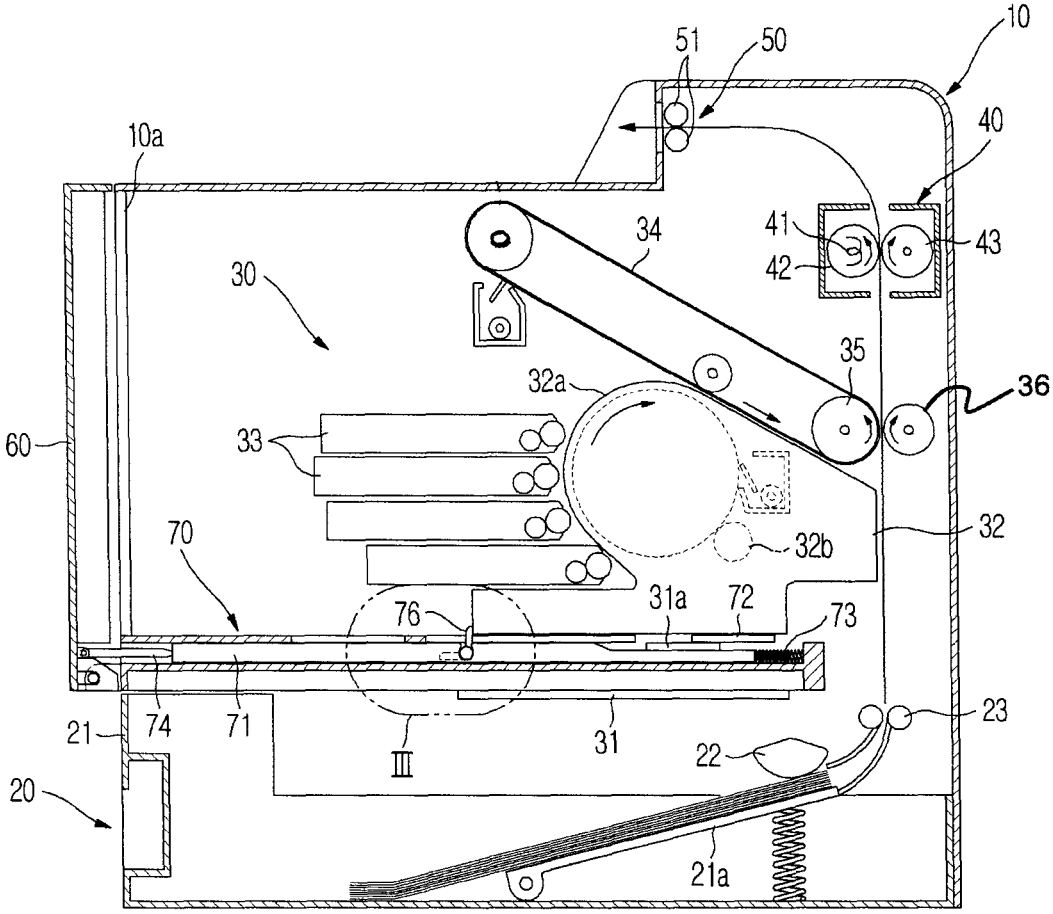
FIG. 1 illustrates a cross-sectional view showing an image forming apparatus according to an embodiment of the present invention with the door being closed.

Reference will now be made in to embodiments of the present invention, examples of which are illustrated in the accompanying drawings, wherein like reference numerals refer to like elements throughout. The embodiments are described below in reference to the figures.

As shown in FIG. 1, an image forming apparatus according to the embodiment includes a main body or housing 10 which defines the external appearance, and/or the internal volume, of the image forming apparatus, within which various internal parts of the image forming apparatus are housed, enclosed and/or supported, a paper supply unit 20 that supplies the printing medium, e.g., sheets of paper, a developing unit 30 that develops an image on the paper, a fixing unit 40 which fixes the image on the paper by applying heat and pressure, and a paper discharge unit 50 which discharges the printed paper out of the main body 10.

In the embodiment shown in FIG. 1, the paper supply unit 20 includes a paper drawer 21 having a paper tray 21*a* on which the paper is loaded, a pickup roller 22, which picks up the paper from the paper tray 21*a*, e.g., one sheet at a time, and feed rollers 23, which feed the picked-up paper to the developing unit 30.

The developing unit 30 may include an exposure unit 31 which irradiates a laser beam according to an image information, a photosensitive cartridge 32 having a photosensitive drum 32*a* on which an electrostatic latent image is formed by the exposure unit 31 and a charge roller 32*b* which charges the photosensitive drum 32*a*. While a single developing cartridge may be sufficient for monochromatic printing, i.e., in only black and white, and while without limiting the scope of the present invention, in this embodiment, there are shown four developing cartridges 33 which develop the electrostatic latent image formed on the photosensitive drum 32*a* into a visible image using developers having colors of yellow (Y), magenta (M), cyan (C) and black (K).

The image forming apparatus of this embodiment may further include an intermediary transfer belt 34, a first transfer roller 35 and a second transfer roller 36. Consumables such as e.g., the photosensitive cartridge 32 and the developing cartridges 33 are detachably installed on the main body 10 so as to be replaceable. For replacement, a first opening 10*a* of the main body 10 provides an access into the internal volume defined by the main body, and allow attachment and detachment of the developing cartridges 33 and/or the photosensitive cartridge 32 to and from the main body 10. An access door 60 is installed on the front of the main body 10 such that the access door 60 rotates, e.g., about a hinge, e.g., at the lower portion of the access door 60 to open and close the first opening 10*a*.

The exposure unit 31 may, e.g., include a laser diode (not shown), which irradiates a laser beam, and a polygon mirror (not shown), which directs the laser beam from the laser diode toward the photosensitive drum 32*a*. A light window 31*a* made of a transparent material is formed on the upper surface of the exposure unit 31 to pass the laser beam from the polygon mirror to the photosensitive drum 32*a*.

The fixing unit 40 fixes the visible image on the paper by applying heat and pressure to the paper. The fixing unit 40 includes a heat roller 42 having a heat source 41, which applies heat to the paper with the transferred developers forming the visible image, and a press roller 43, which is installed to face the heat roller 42 so as to maintain a predetermined fixing pressure between the heat roller 42 and the press roller 43.

The paper discharge unit 50 includes a series of discharge rollers 51, which are sequentially installed to direct the paper that has passed through the fixing unit 40 to outside of the main body 10.

Figure 2:
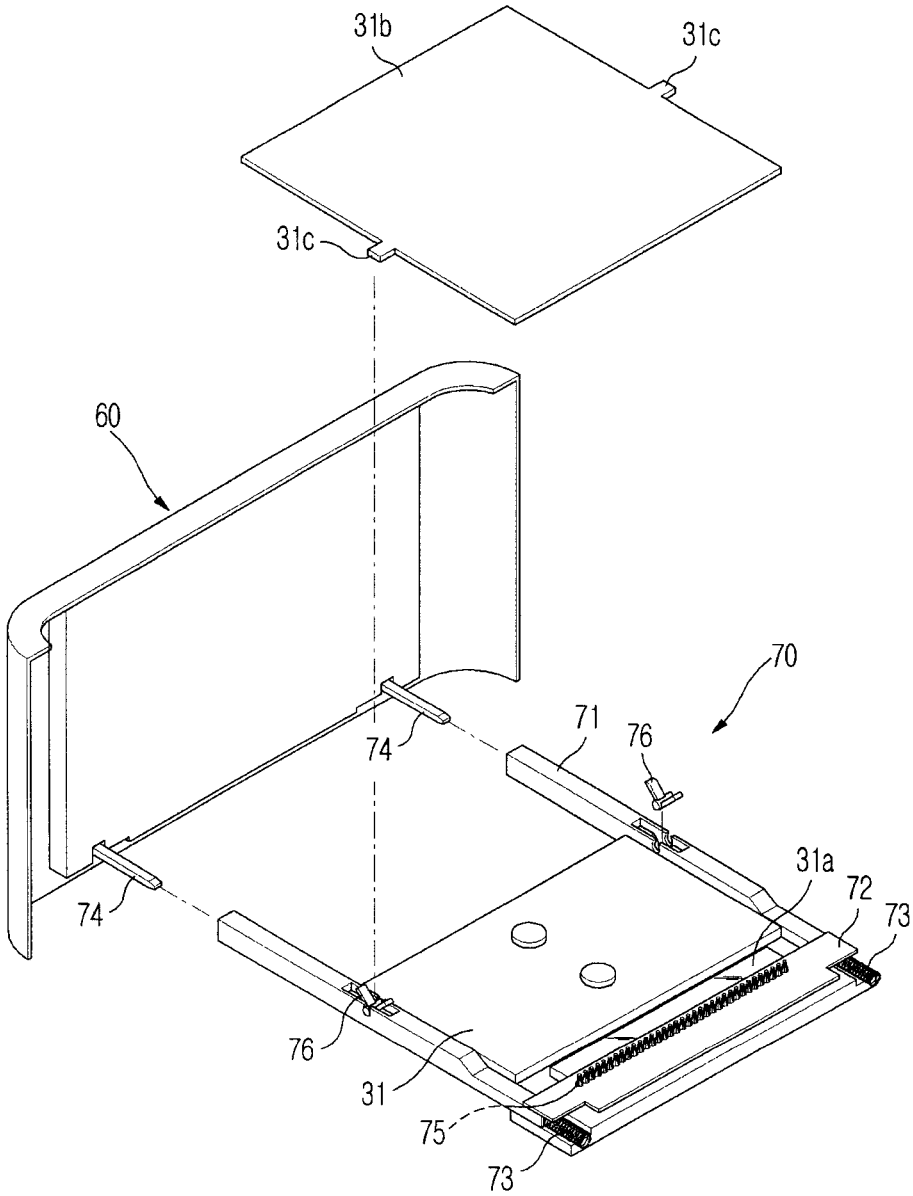
FIG. 2 illustrates a perspective view showing a light window opening/closing unit when the door is closed in the image forming apparatus of FIG. 1.

Further, as shown in FIG. 2, a light window opening/closing unit 70 is disposed above the light window 31*a* of the exposure unit 31 so as to expose the light window 31*a* only when the access door 60 is closed, thereby selectively blocking the laser beam from the exposure unit 31 to avoid the risk of injury of a user when the access door is open, and when the user is accessing the internal area of the main body 10.

The light window opening/closing unit 70 includes a pair of slide bars 71 extending in the depth (i.e., front to rear) direction of the main body 10, and which are disposed on opposite sides of the light window 31*a*. As will be explained in more detail later, the slide bars 71 move in association with the opening and closing operation of the access door 60 such that, during the opening of the access door 60, the slide bars 71 move toward the opening 10*a*, and, during the closing of the access door 60, they move in the opposite direction, i.e., away from the opening 10*a*. A light window cover 72 having each of its opposite ends coupled to the respective one of the slide bars 71 moves together with the slide bars 71 so that the light window cover 72 is placed over, and thus covers, the light window 31*a* when the access door 60 is open, and does not cover the light window 31*a* when the access door 60 is closed. The elastic members 73 elastically bias the slide bars 71 toward the opening 10*a*.

The pressing bars 74, each of which having an end thereof hingedly coupled to the access door 60, and which is arranged so that each of the other ends of the pressing bars 74 to be in alignment with the end of the respective one of the slide bars 71 when the access door 60 closes so as to push the slide bars 71 away from the opening 10*a*. The pressing bars 74 transfer a portion of the force, which is exerted on the access door 60 during the closing of the access door 60, to the slide bars 71 such that the slide bars 71 move away from the opening 10*a*. A brush 75 may be installed on the light window cover 72 to sweep and clean surface of the light window 31*a*. Accordingly, as the access door 60 opens and closes, the light window 31*a* can be cleaned by the brush 75.

Further, the image forming apparatus according to the present embodiment includes locking members 76, which, engages with a portion of the body of, and thus secures, the photosensitive cartridge 32 in place when the access door 60 is closed to prevent the photosensitive cartridge 32 from moving within the main body 10, e.g., during transporting of the image forming apparatus.

Figure 3:
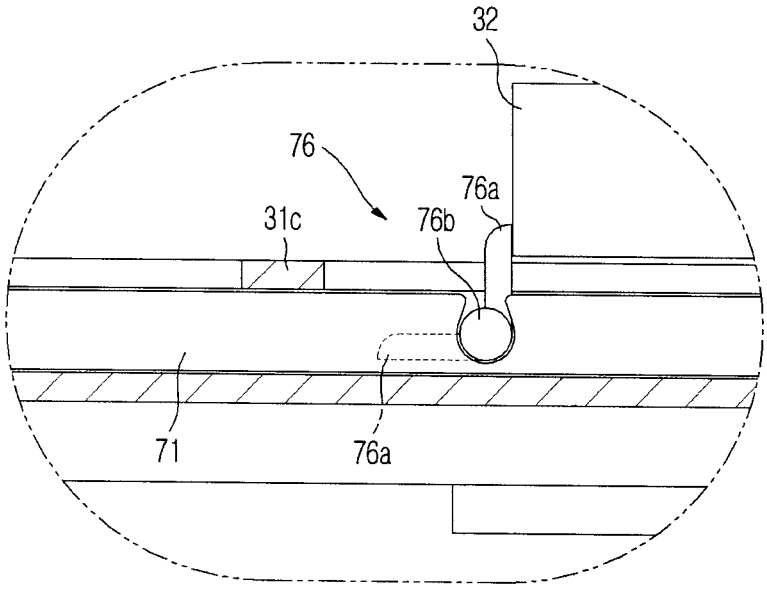
FIG. 3 illustrates an enlarged view of a portion indicated by |.parallel.

The locking members 76 are rotatably installed on the slide bars 71, and are made to rotate as the slide bars 71 move toward and away from the opening 10*a* to lock into place or to release the photosensitive cartridge 32. As shown in FIG. 3, each of the locking members 76 includes a pair of hook members 76*a* together forming a V shape with a specific angle therebetween and a hinge portion 76*b* protruding outward from opposite sides of the portion connecting the hook members 76*a*, the hinge portion 76*b* being rotatably installed in the circular groove formed on each of the slide bars 71. Engaging protrusions 31*c* are disposed to interfere with, and thus to cause the rotation of, the locking members 76 as the slide bars 71 move toward and away from the opening 10*a*, and thereby causing the locking members 76 to lock in place of release the photosensitive cartridge 32. Each of the engaging protrusions 31*c* engages or interferes with any one of the pair of the hook members 76*a* to rotate the locking members 76. In this embodiment, the engaging protrusions 31*c* are formed to protrude from opposite ends of the cover plate 31*b*, which covers the upper portion of the exposure unit 31 to form the upper surface thereof.

An operation of the image forming apparatus having the above configuration will now be described in detail.

First, when the access door 60 is being closed, a portion of the force exerted to close the access door 60 is transferred to the slide bars 71 through the pressing bars 74, and the slide bars 71 move away from the opening 10*a* while compressing or otherwise deforming the elastic members 73. The light window cover 72 coupled to the slide bars 71 moves in the same direction as the slide bars 71 to expose the light window 31*a* so that the laser beam from the exposure unit 31 can pass to the photosensitive drum 32*a* through the light window 31*a*. The locking members 76 also move away from the opening 10*a* together with the slide bars 71, and the hook members 76*a* of which formed closer to the opening 10*a* are interfered with by the engaging protrusions 31*c*, and is rotated to the horizontally extended position shown in FIG. 3 while the other ones of the hook members 76*a* extend vertically to support and to secure the photosensitive cartridge 32 in place. Thus, notwithstanding the possible vibrations during, e.g., transport of the image forming apparatus, since the photosensitive cartridge 32 is maintained securely in place by the locking members 76, it is possible to prevent possible damages of the photosensitive cartridge 32 from being moved within the main body 10.

Figure 4:
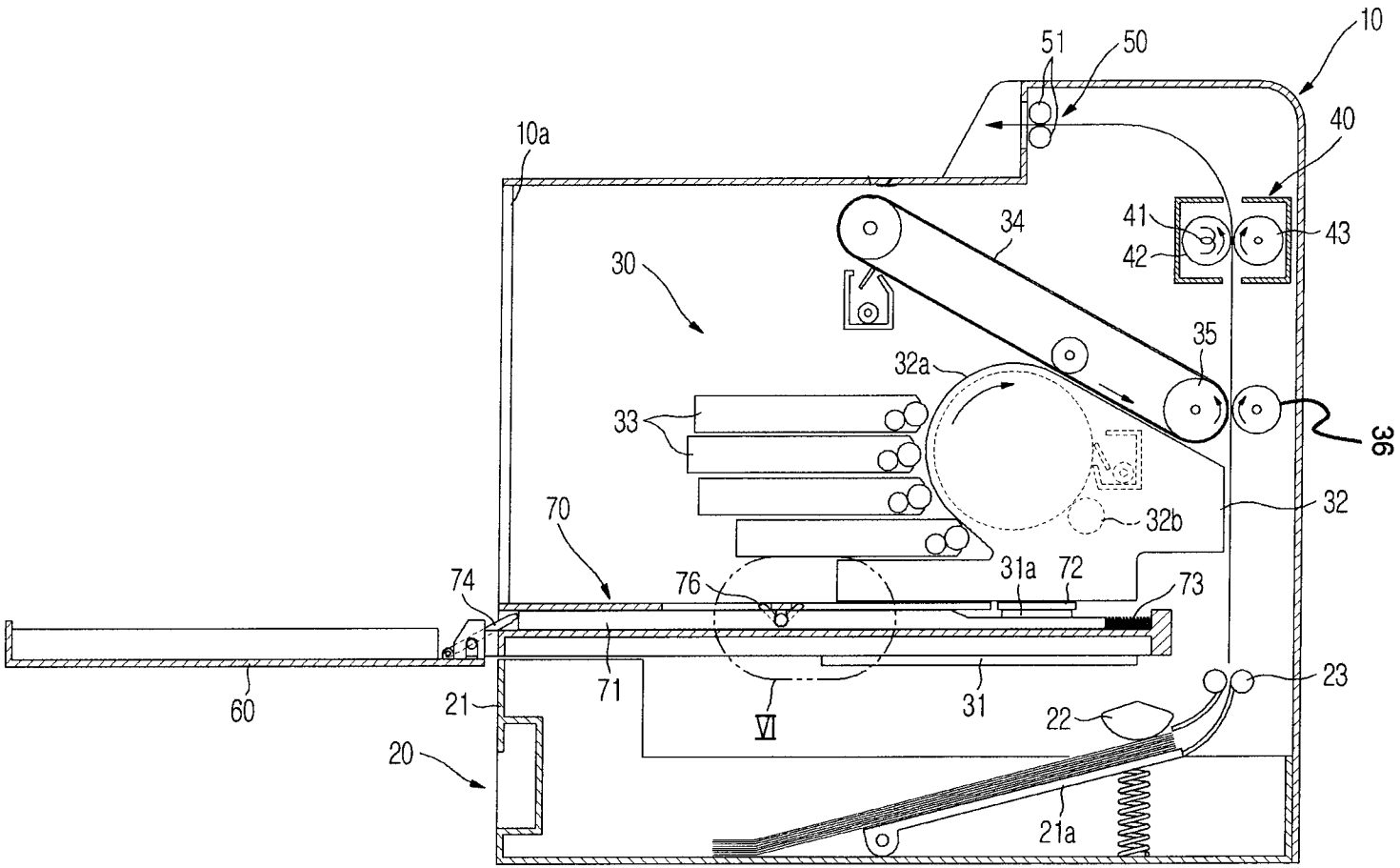
FIG. 4 illustrates a cross-sectional view showing the image forming apparatus of FIG. 1 with the door open.
Figure 5:
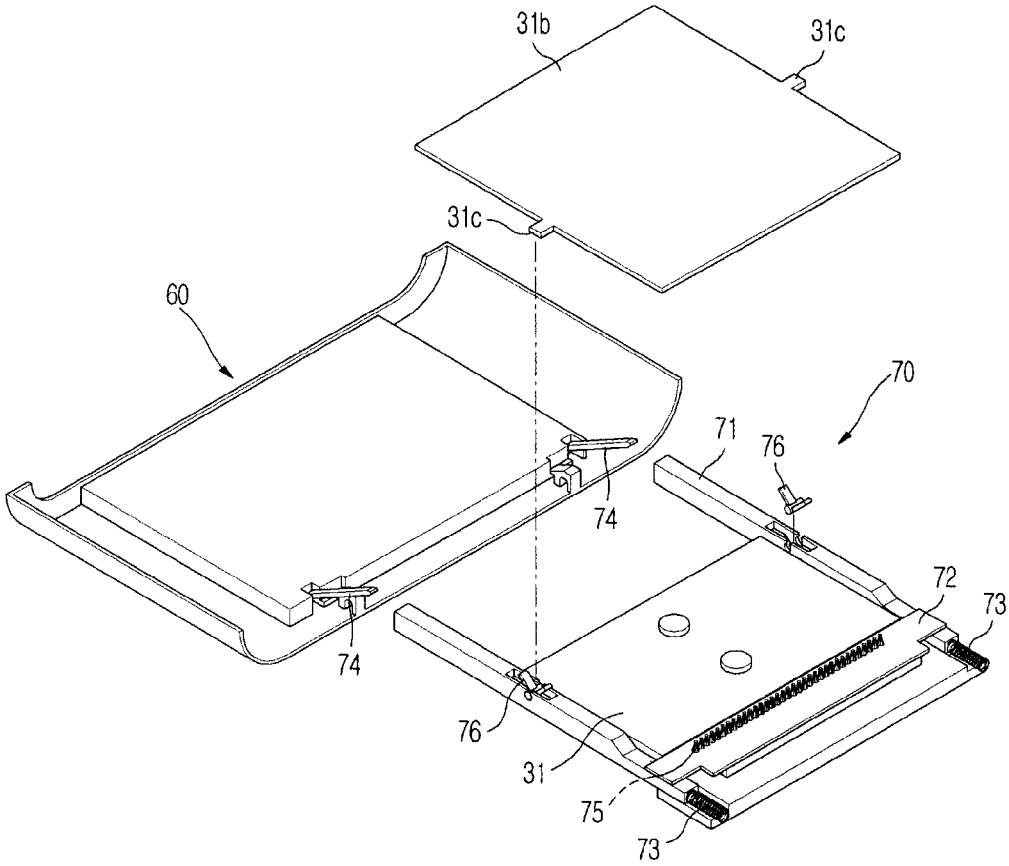
FIG. 5 illustrates a perspective view showing the light window opening/closing unit when the door is open in the image forming apparatus of FIG. 1.
Figure 6:
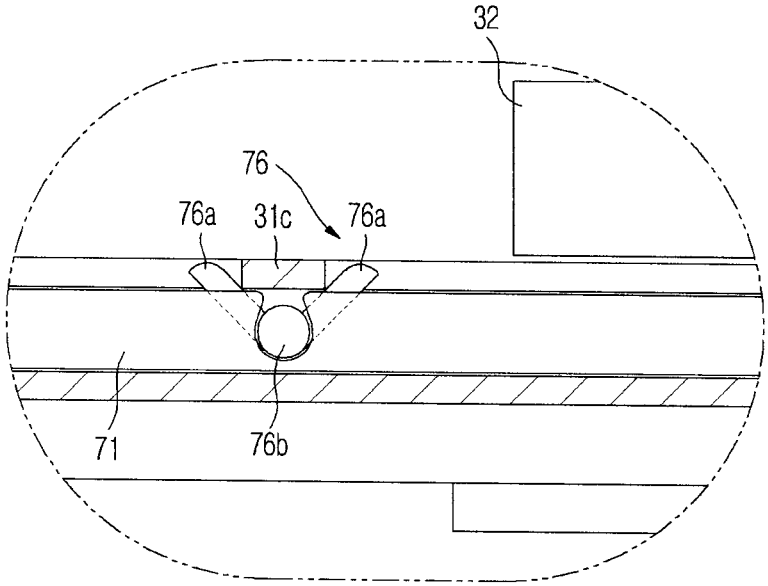
FIG. 6 illustrates an enlarged view of a portion indicated by VI in FIG. 4.

Next, as shown in FIG. 4, when the access door 60 opens, the force applied to the slide bars 71 by the pressing bars 74 is removed. Accordingly, as shown in FIG. 5, the bias from the elastic members 73 causes the slide bars 71 to move toward the opening 10*a*. Thus, the light window cover 72 installed at the slide bars 71 covers the light window 31*a* to prevent the laser beam generated in the exposure unit 31 from reaching beyond the light window cover 72. The brush 75 installed on the light window cover 72 sweeps the upper surface of the light window 31*a* to remove foreign objects, e.g., dirt, toner particles, etc., from the upper surface of the light window 31*a*. Further, while the slide bars 71 move toward the opening 10*a*, as shown in FIG. 6, the hook members 76*a* further from the opening 10*a* are separated from the photosensitive cartridge 32 to release the photosensitive cartridge 32. Accordingly, the photosensitive cartridge 32 can be detached from the main body 10. The hook members 76*a* further from the opening 10*a* engage with the engaging protrusions 31*c* to rotate the locking members 76 so as not to interfere with the photosensitive cartridge 32 being detached.

Figure 7:
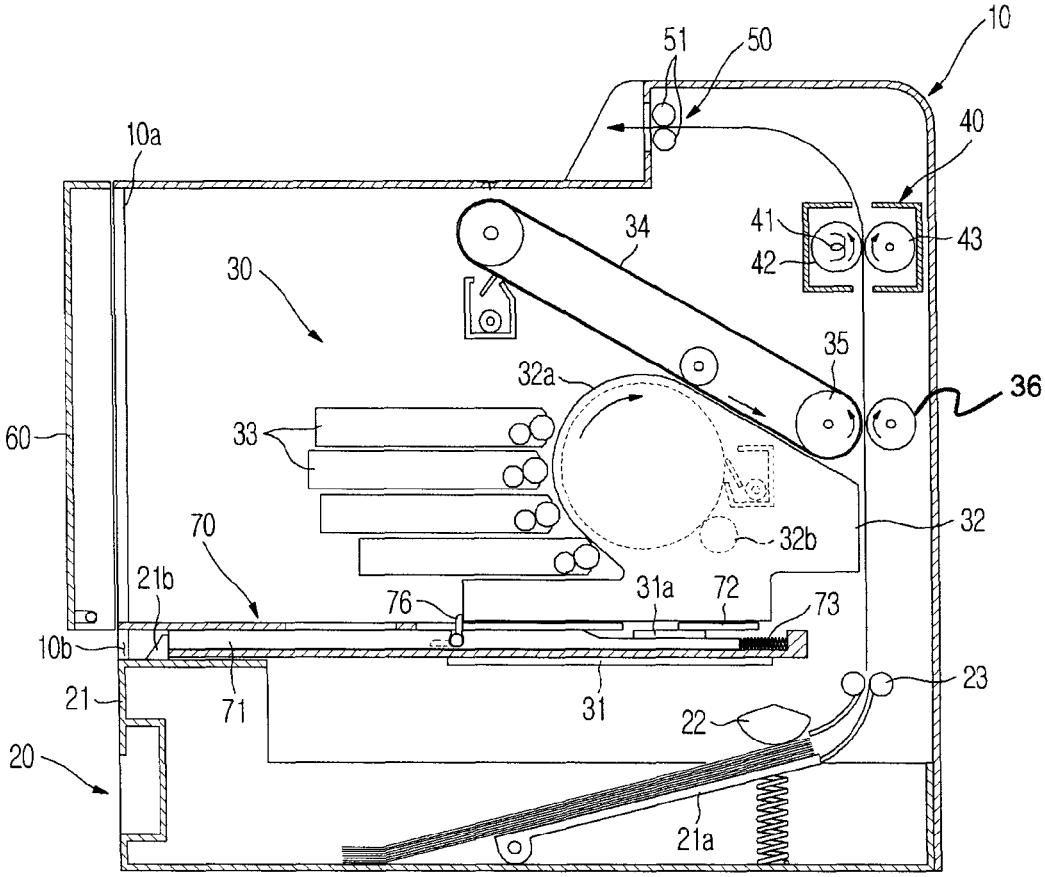
FIGS. 7 and 8 illustrate cross-sectional views showing an operation of an image forming apparatus according to another embodiment.

FIG. 7 shows another embodiment of the image forming apparatus according to the present invention. The image forming apparatus according to this embodiment includes a second opening 10*b* installed on the front surface of the main body 10 such that the paper drawer 21 can move in and out of the main body 10 through the second opening 10*b*.

The image forming apparatus according to this embodiment can secure or release consumables, e.g., the photosensitive cartridge 32, installed in the main body 10 by the movement of the paper drawer 21 in and out of the main body 10.

According to this embodiment, the slide bars 71 move toward and away from the second opening 10*b* in association with the movement of the paper drawer 21 in and out of the main body 10. As with the previous embodiments, the locking members 76 installed on the slide bars 71 rotate as the slide bars 71 move to secure in place or release the consumable(s). Also as before, one ends of the slide bars 71 are elastically biased by the elastic members 73 toward the second opening 10*b*. The other ends of the slide bars 71 are arranged to interfere with the pressing protrusions 21*b* protruding upward from the paper drawer 21.

Similarly with the previous embodiments described in references to FIGS. 1 through 6, each of the locking members 76 includes a pair of hook members 76*a* forming a V shape of a specific angle and a hinge portion 76*b*, which protrude outward from the opposite sides of the portion connecting the hook members 76*a*. Each hinge portion 76*b* is rotatably installed in the groove formed on the respective one of the slide bars 71. In this embodiment, the engaging protrusions 31*c* are disposed on the main body 10 to protrude into the main body 10 such that each of the engaging protrusions 31*c* engages with any one of the pair of the hook members 76*a* to rotate the locking members 76.

Thus, when the paper drawer 21 moves into the main body 10 through the second opening 10*b*, a portion of a force exerted to move the paper drawer 21 is transferred to the slide bars 71 through the pressing protrusions 21*b*, and the slide bars 71 move away from the second opening 10*b* while in the process elastically deforming the elastic members 73. As the slide bars 71 continue to move away from the second opening 10*b*, the hook members 76*a* formed nearer to the second opening 10*b* are engaged with the engaging protrusions 31*c* to rotate the locking members 76. Further, the hook members 76*a* formed further from the second opening 10*b*, engage with a portion of the body of, and thus support and secure in place, the photosensitive cartridge 32.

Figure 8:
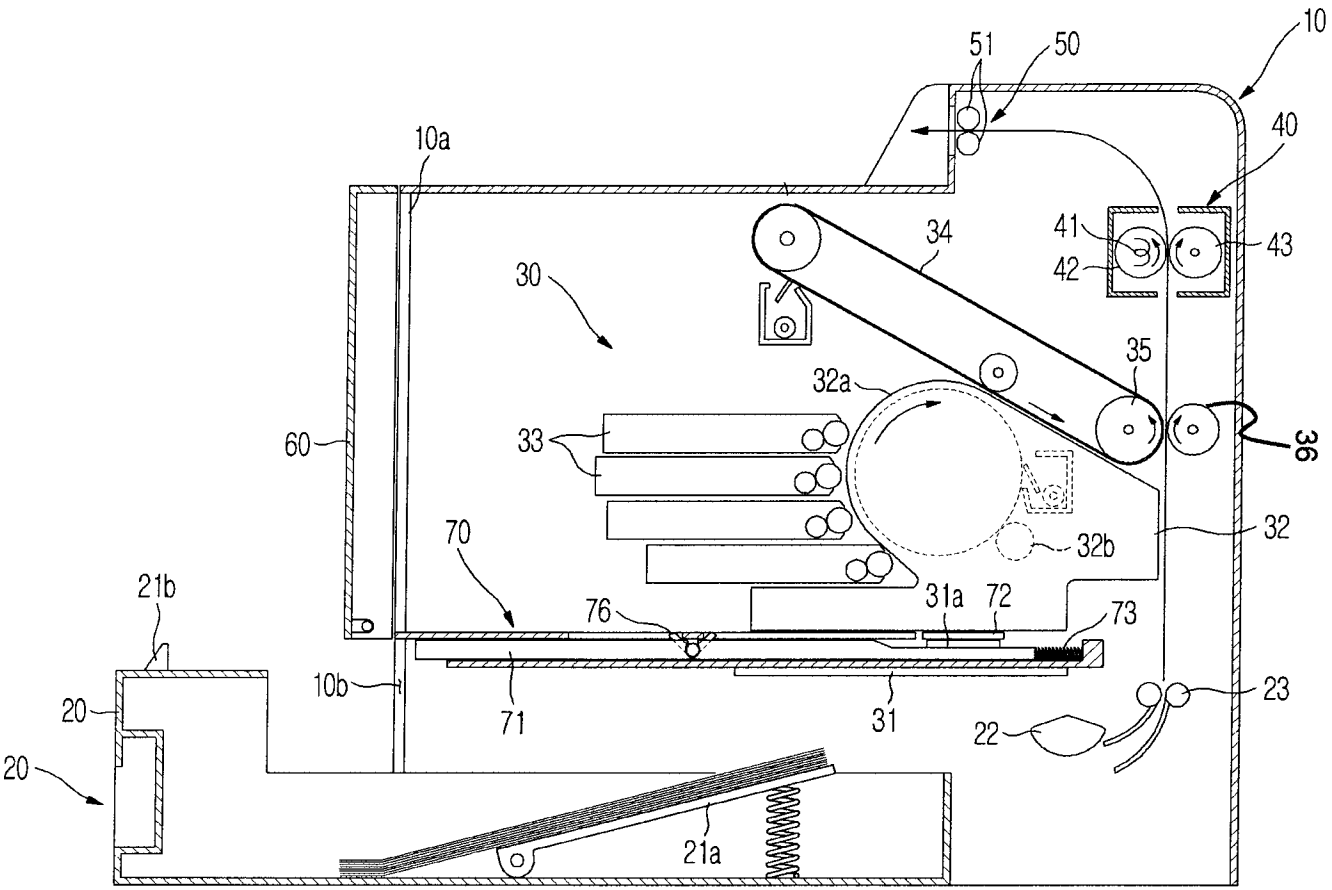

Further, as shown in FIG. 8, the paper drawer 21 moves out of the main body 10 through the second opening 10*b*, thereby removing the force applied to the slide bars 71 through the pressing protrusions 21*b*. Accordingly, due to the elastic bias of the elastic members 73, the slide bars 71 move toward the second opening 10*b*. As the slide bars 71 continue to move forwarding that direction, the hook members 76*a* formed further from the second opening 10*b* are separated from the photosensitive cartridge 32 to release the photosensitive cartridge 32. Thus, the photosensitive cartridge 32 can be detached from the main body 10.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a main body having an opening;

a door to open or close the opening;

a photosensitive cartridge having a photosensitive drum;

an exposure unit having a light window, to irradiate light to the photosensitive drum;

a slide bar installed at the main body, the slide bar being movable in accordance with opening and closing operations of the door;

a light window cover installed at the slide bar, to open or close the light window while moving together with the slide bar; and a locking member installed at the slide bar, to selectively lock the photosensitive cartridge in accordance with a position of the slide bar.

2. The image forming apparatus according to claim 1, wherein the slide bar is moved into the main body when the opening is closed by the door, and is moved to the opening when the opening is opened by the door.

3. The image forming apparatus according to claim 1, wherein the locking member moves to a locking position, at which the locking member locks the photosensitive cartridge, when the slide bar moves into the main body, and moves to a release position, at which the photosensitive cartridge is movable, when the slide bar moves to the opening.

4. The image forming apparatus according to claim 3, wherein the locking member is rotatably installed at the slide bar, to rotate between the locking position and the release position in accordance with the movement of the slide bar.

5. The image forming apparatus according to claim 3, wherein the light window cover is moved to a first position, at which the light window cover covers the light window, when the slide bar moves to the opening, and is moved to a second position, at which the light window cover does not cover the light window, when the slide bar moves into the main body.

6. The image forming apparatus according to claim 4, wherein the locking member comprises a pair of hook members forming a predetermined angle therebetween, and a hinge provided at a connecting portion of the hook members and rotatably installed at the slide bar.

7. The image forming apparatus according to claim 6, wherein the exposure unit comprises an engaging protrusion to be engagable with any one of the hook members in accordance with the movement of the slide bar, to rotate the locking member.

8. The image forming apparatus according to claim 1, further comprising:

an elastic member to elastically urge the slide bar toward the opening; and a pressing protrusion installed at the door, to press the slide bar to move into the main body when the door closes the opening.

* * * * *